United States Patent [19]

Nagaura

[11] Patent Number: 4,494,338

[45] Date of Patent: Jan. 22, 1985

[54] LENS-SHAPED ARTICLE OR THE LIKE AND A METHOD AND APPARATUS FOR THE MANUFACTURE OF SAME

[76] Inventor: Yoshiaki Nagaura, No. 391-2, Tonoharu, Oaza, Chikushino-shi, Fukuaka-ken, Japan

[21] Appl. No.: 536,514

[22] Filed: Sep. 28, 1983

Related U.S. Application Data

[62] Division of Ser. No. 353,251, Mar. 1, 1982.

[30] Foreign Application Priority Data

Mar. 5, 1981 [JP] Japan ..... 56-32848
Jun. 12, 1981 [JP] Japan ..... 56-91240

[51] Int. Cl.[3] ..... B24B 13/00

[52] U.S. Cl. ..... 51/33 W; 51/284 R; 51/89

[58] Field of Search ..... 51/33 W, 105 LG, 106 LG, 51/284 R, 89, 88, 33 R, 42, 55, 81 R, 118; 82/1 C, 11

[56] References Cited

U.S. PATENT DOCUMENTS 2,633,675 4/1953 Ellis ..... 51/284
2,806,327 9/1957 Coburn ..... 51/33 W
3,492,764 2/1970 Dalton ..... 51/284
3,528,326 9/1970 Kilmer et al. ..... 51/284 E
3,686,796 8/1972 Clark ..... 51/284 E
3,810,403 5/1974 Ianuzzi et al. ..... 51/284 E
3,909,982 10/1975 Schlotfeldt ..... 51/284 R
4,084,458 4/1978 Galley ..... 51/105 LG

FOREIGN PATENT DOCUMENTS 23800 2/1981 European Pat. Off. ..... 51/284 R

*Primary Examiner*—Frederick R. Schmidt
*Assistant Examiner*—Robert A. Rose
*Attorney, Agent, or Firm*—McGlew and Tuttle

[57] ABSTRACT

A lens-shaped article or the like which has a support frame formed as a unitary structure with the outer periphery of the lens-shaped body, and a method and apparatus for the manufacture of such a lens-shaped article or the like. The manufacturing method and apparatus are of particular utility when employed for the manufacture of small resonators. Also when the resonators are formed as small as possible, it is possible to obtain high Q and prevent sub-vibration. In the case of a framed lens, it can easily be assembled with high precision.

2 Claims, 12 Drawing Figures

LENS-SHAPED ARTICLE OR THE LIKE AND A METHOD AND APPARATUS FOR THE MANUFACTURE OF SAME

This is a division of application Ser. No. 353,251 filed Mar. 1, 1982 (pending).

BACKGROUND OF THE INVENTION

1. Field of the Invention

The present invention relates to a lens-shaped article or the like and a method and apparatus for the manufacture of the same.

2. Description of the Prior Art

It is difficult to support a crystal resonator having its both surfaces machined into lens-shaped configurations. In the past there has been employed a method of supporting the crystal resonator at several points on its circumference by means of a mica plate or the like having a V-shaped cross section. In this case, since mismatching of vibration naturally occurs between the resonator and the support system, even if the resonator is made as small as possible and with a high quality factor Q, there are possibilities that the mismatching impairs the Q and yields sub-vibration.

The crystal resonator must be formed at a certain angle bearing an important relation to the crystal axis of a work but, with the prior art, only one surface of the work can be machined so as to retain the axis.

SUMMARY OF THE INVENTION

It is therefore an object of the present invention to provide a lens-shaped article or the like, such as a grooved and ring-supported resonator, which is free from vibration between it and its support system and is capable of preventing the occurrence of sub-vibration.

Another object of the present invention is to provide a lens-shaped article or the like manufacturing method which is capable of machining both surfaces of a work, without changing the axis for machining, by transferring the work from one work holder to the other on the same axis for machining.

Yet another object of the present invention is to provide apparatus for the manufacture of a lens-shaped article or the like.

These and other objects and advantages of the present invention will become more apparent by referring to the following detailed description and accompanying drawings.

DESCRIPTION OF THE PREFERRED EMBODIMENTS

Figure 1A:
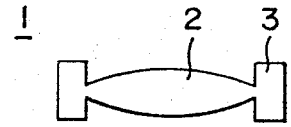
FIGS. 1(*a*) to 1(*h*) are sectional views of various framed lens-shaped articles produced according to the present invention.
Figure 1B:
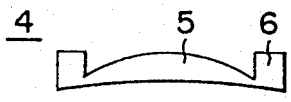
Figure 1C:
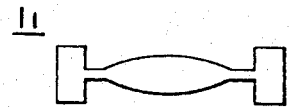
Figure 1D:
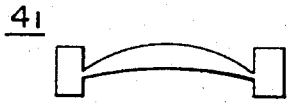
Figure 1E:
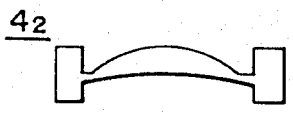
Figure 1F:
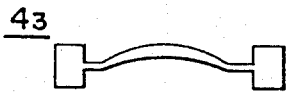
Figure 1G:
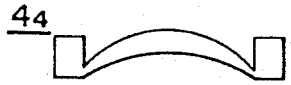
Figure 1H:
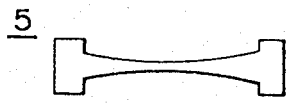

FIGS. 1(*a*) and 1(*h*) illustrate grooved and ring-supported resonators (or lens-shaped articles and the like) produced according to the present invention. A grooved and ring-supported resonator 1 shown in FIG. 1(*a*) is constituted by forming a support frame 3 as a unitary structure with a biconvex resonator body at the outer periphery thereof. A grooved and ring-supported resonator 4 shown in FIG. 1(*b*) is constituted by forming a support frame 6 as a unitary structure with a convex-concave resonator body 5 at the outer periphery thereof.

As the grooved and ring-supported resonator of the present invention has the support frame formed integrally with the outer periphery of the lens-shaped resonator body as mentioned above, it can be held easily and positively using the support frame. In addition, it is possible to prevent mismatching of vibration between the resonator and the support system and occurrence of sub-vibration; therefore, even if the resonator is made as small as possible, its Q can be held high.

Such a grooved and ring-supported resonator can be obtained through the use of manufacturing apparatus shown in FIGS. 2 to 5.

Next, a description will be given of the arrangement and operation of the illustrated apparatus.

Figure 2:
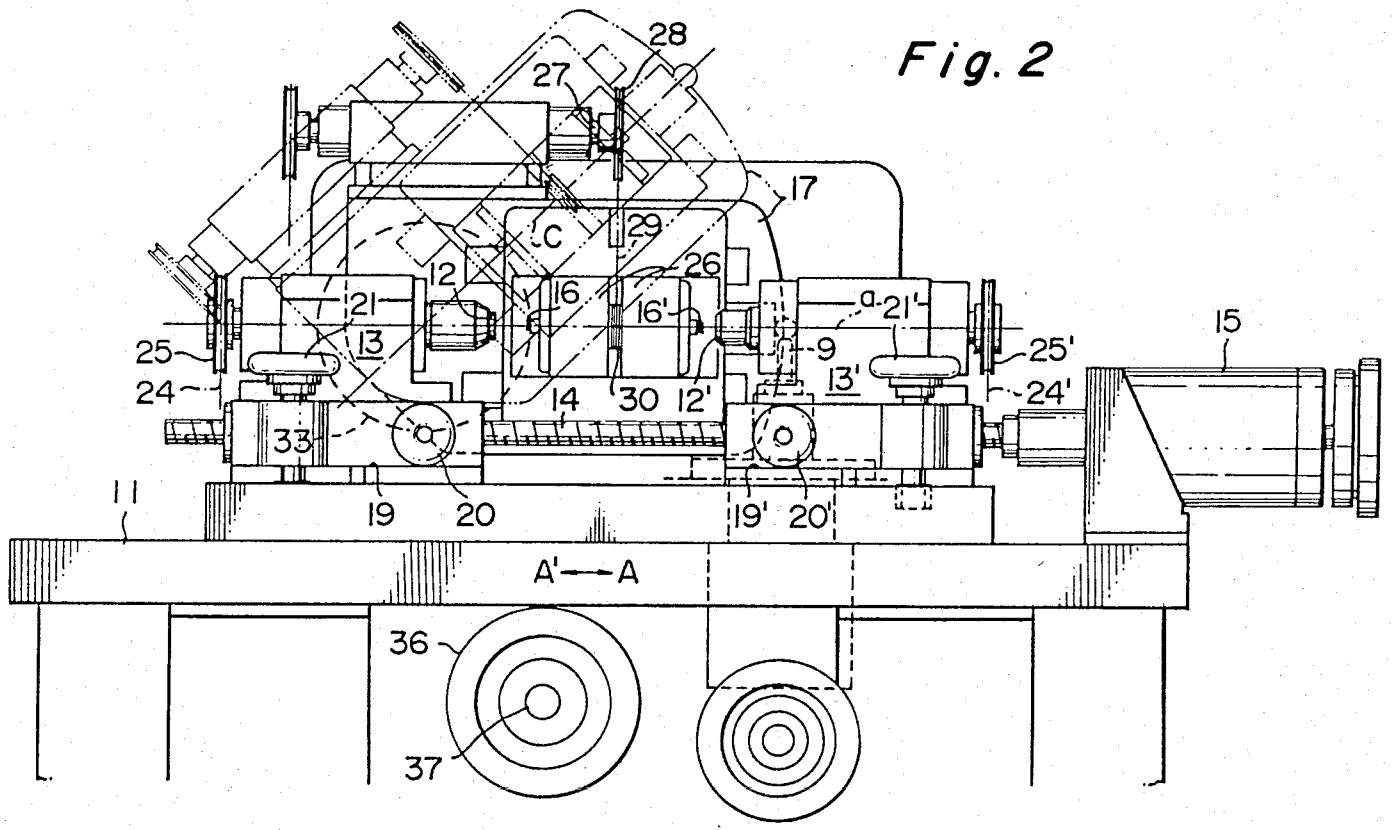
FIG. 2 is a front view of lens-shaped article or the like manufacturing apparatus of the present invention.
Figure 3:
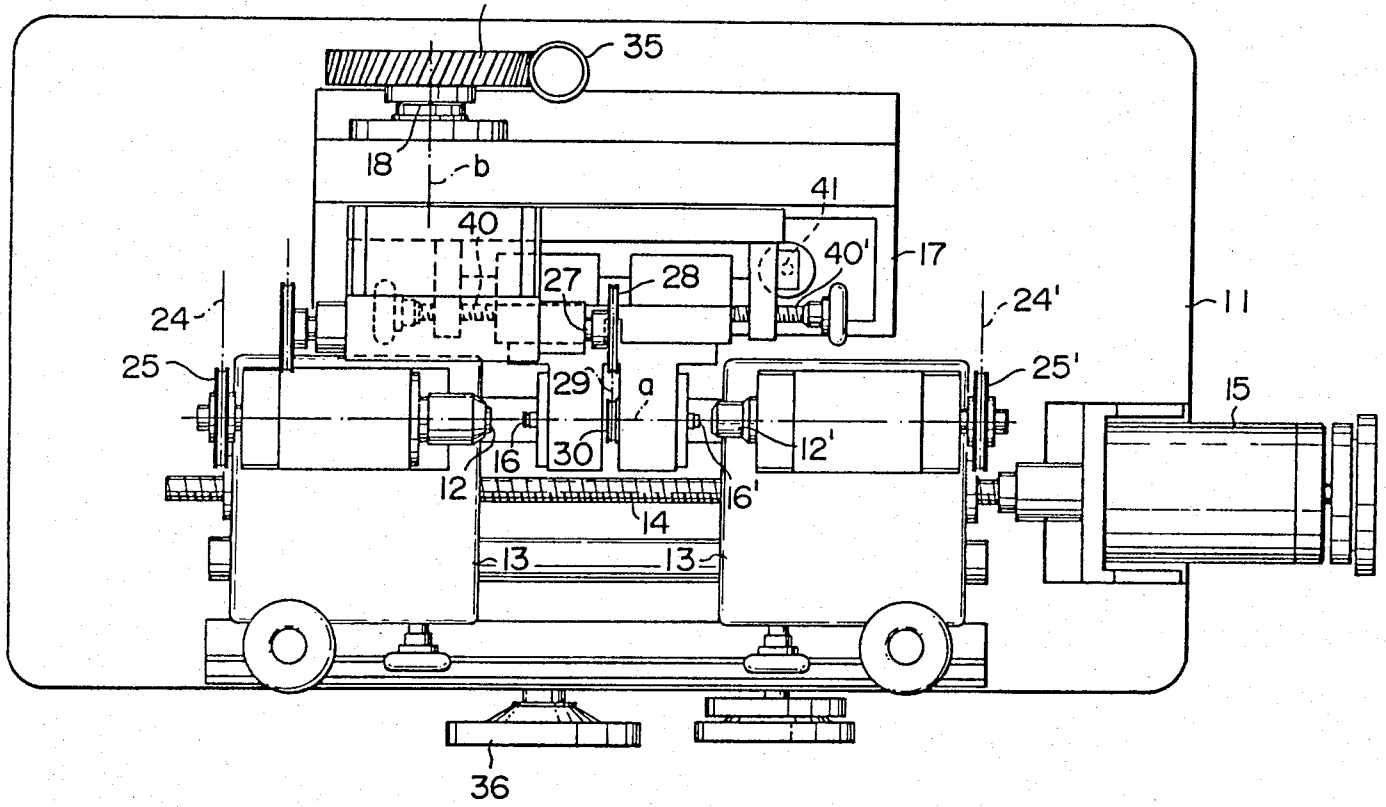
FIG. 3 is its plan view.
Figure 4:
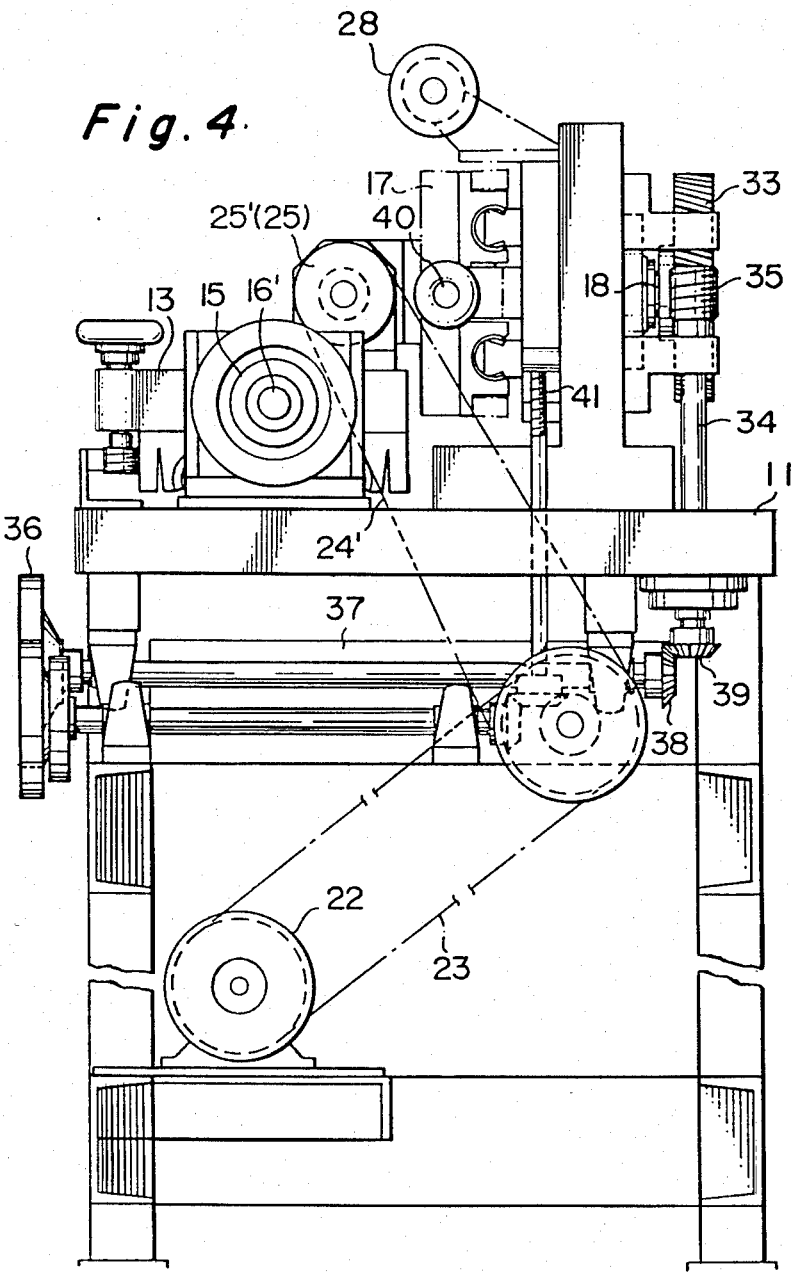
FIG. 4 is its side view.
Figure 5:
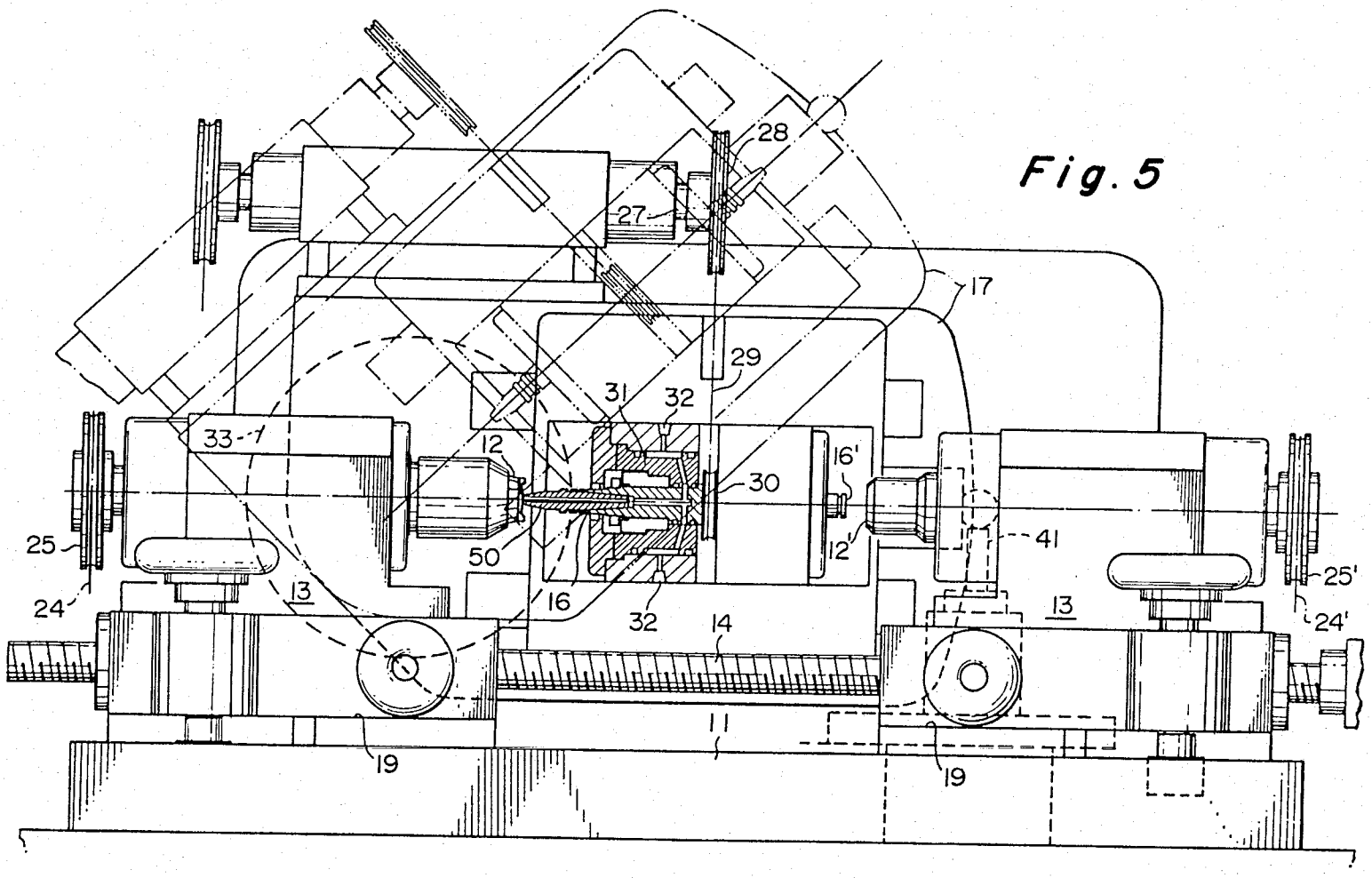
FIG. 5 is an enlarged view, partly cut away, of one portion of FIG. 2.
Figure 6A:
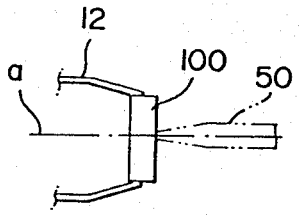
FIGS. 6(*a*) to 6(*e*) are schematic diagrams showing the steps of machining one side of a work held by one work holder and then machining the surface of a machinable piece attached to the machine, surface of the work.
Figure 6B:
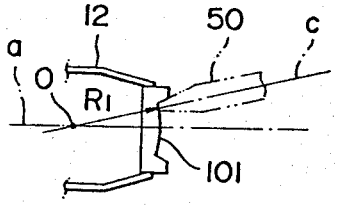
Figure 6C:
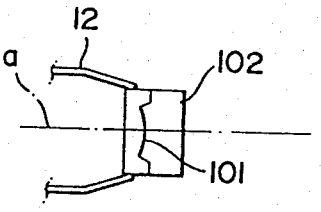
Figure 6D:
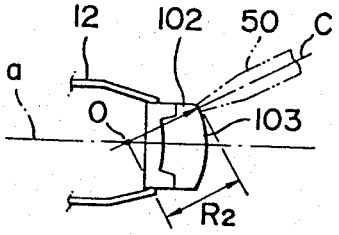
Figure 6E:
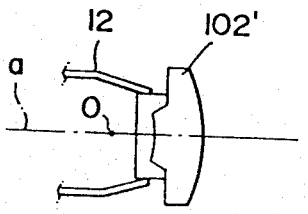

FIG. 2 is a front view of the apparatus, FIG. 3 its plan view, FIG. 4 its side view and FIG. 5 is an enlarged view, partly cut away, of FIG. 2. In FIGS. 2 to 5, reference numeral 11 indicates a chassis; 12 and 12′ designate work holders; 13 and 13′ identify support bases; 14 denotes a horizontal feed screw; 15 represents a reversible NC servo motor; 16 and 16′ show tool holders; 17 refers to a frame; and 18 indicates a spindle.

The support bases 13 and 13′ are mounted on the chassis 11 in a manner to be slidable on rails 19 and 19′ in directions A and A′ indicated by arrows in FIG. 2 and the horizontal feed screw 14 which is threadably enlarged with the support bases 13 and 13′ is coupled directly with the output shaft of the NC servo motor 15. Accordingly, driving the NC servo motor 15 to rotate the horizontal feed screw 14, the support bases 13 and 13′ are guided by the rails 19 and 19′ to move in the direction A or A′. Reference numerals 20 and 20′ indicate handles for engaging the support bases 13 and 13′ with the horizontal feed screw 14; and, 21 and 21′ designate handles for locking the support bases 13 and 13′. Though not shown, when turning the handle 20 in its positive direction, a female screw provided in the support base 13 is threadably engaged with the horizontal feed screw 14 and, when turning the handle 20 in the backward direction, the female screw is disengaged from the horizontal feed screw 14. Accordingly, the support base 13 can be moved to a predetermined position by driving the NC servo motor 15 after manipulating the handle 20 to engage the female screw with the horizontal feed screw 14. The support base 13 is locked at the predetermined position by manipulating the lock handle 21. By similar manipulation of the handles 20' and 21', the support base 13' can be brought to a predetermined position and locked there. In this case, it is also possible, of course, to move the support bases 13 and 13' simultaneously.

The work holder 12 is the chuck type and the work holder 12' is the suction type that an O ring for hermetic sealing is attached to the tip of a pipe connected to a vacuum source. The work holders 12 and 12' are rotatably mounted on the support bases 13 and 13' in such a manner that the axes of the holders are in alignment with a reference center axis a. As shown in FIG. 4, the work holders 12 and 12' are driven by a motor 22 through belts 23, 24 and 24' and pulleys 25 and 25', the motor 22 being provided under the chasis 11.

The tool holders 16 and 16' are detachably mounted on a support frame 26 provided on the frame 17. The tool holders 16 and 16' are driven to rotate about a common axis c (see FIG. 2) through a belt 29 and a pulley 30 by a pulley 28 fixed to a rotary shaft 27 which is driven by a driving source (not shown) mounted on the frame 17. A description will be given, with reference to FIG. 5, of how a tool is held by the tool holder 16 which is identical with the other tool holder 16'. The tool holder 16 is fixed to a rotary member 31 rotatably supported by the support frame 26 and a tool 50 for machining the surface of a work, which is held by the work holder 12 is detachably held by the tool holder 16. Reference numeral 32 indicates an antifriction composition supply port which communicates with a center hole 51 of the tool 50.

The frame 17 is rotatably about a horizontal axis b (see FIG. 3) which is perpendicular to the aforementioned common center axis a. The horizontal axis b corresponds to the axis of the spindle 18 which is mounted on the frame 17. To the spindle 18 is affixed a worm wheel 33, with which meshes a worm 35 fixed to a worm shaft 34 rotatably mounted on the chassis 11. The rotational movement of the frame 17 is performed by turning a tilting handle 36 (see FIG. 4) to rotate a bevel gear shaft 37 rotatably provided under the chassis 11, thereby turning the worm 35 through a bevel gear 38 fixed to the shaft 37 and a bevel gear 39 fixed to the worm shaft 34. The axis c, common to the tool holders 16 and 16' supported by the support frame 26 on the frame 17, passes through the intersection of the reference axis a and the horizontal axis b and crosses the axis b at right angles thereto. The support frame 26, in this example, is mounted on the frame 17 in a manner to be movable in the direction of the common axis c. By turning position adjusting screws 40 and 40' threadably engaged with the frame 17, the position of the support frame 26 can be adjusted in the direction of the common axis c; that is to say, the support frame 26 is positioned by the screws 40 and 40'. When turned to such a position where the common axis c is in alignment with the reference center axis a, the frame 17 is retained by a stopper 41 to be positioned there. By arranging the stopper 41 so that its position may be adjusted in the upward direction, it is possible to bring the common axis c accurately into aligment with the reference center axis a absorbing errors which occur in respective parts of the apparatus.

The grooved and ring-supported resonators shown in FIGS. 1(*a*) and 1(*b*) can easily be obtained by the above-said apparatus in the following procedure:

Next, a description will be given, with reference to FIGS. 6(*a*) to 6(*d*), 7, 8, and 9, of the machining procedure.

At first, the frame 17 is turned to the position of the stopper 41 to bring the common axis c into alignment with the common center axis a and a work of crystal 100 is mounted on the one work holder 12. Then the tool holder 16 holding the tool 50 is rotated and the work holder 12 is moved forward in the direction of the arrow A while being rotated. In this way, the work 100 is brought into contact with the tool 50 as shown in FIG. 6(*a*).

Next, the frame 17 is turned through a predetermined angle in a direction indicated by the chain line in FIG. 2, by which the tool 50 is moved, along with the frame 17, to the position shown in FIG. 6(*b*). During this movement the central portion of the surface of the work 100 is machined by the tool 50 into a sperical surface 101 with a radius $R_1$ centering around the intersection O of the common center axis a and the horizontal axis b.

After this, the work holder 12 is moved back to the left as shown in FIG. 6(*c*) and the work holder 12 and the tool 50 are once stopped from rotation. And then a machinable piece 102 is stuck by an adhesive binder to the machined surface of the work 100.

Next, the work holder 12 and the tool 50 are rotated and the work holder 12 is moved forward to work the surface of the machinable piece 102 by the tool 50 into a spherical surface 103 with a radius $R_2 (=R_1)$ centering around the aforesaid intersection O as depicted in FIG. 6(*d*).

In the case of machining a work of a small diameter, if a large-diametered machinable piece is used as indicated by 102' in FIG. 6(*e*), then the work can easily be transferred from one work holder to the other one as will be described hereunder.

Figure 7:
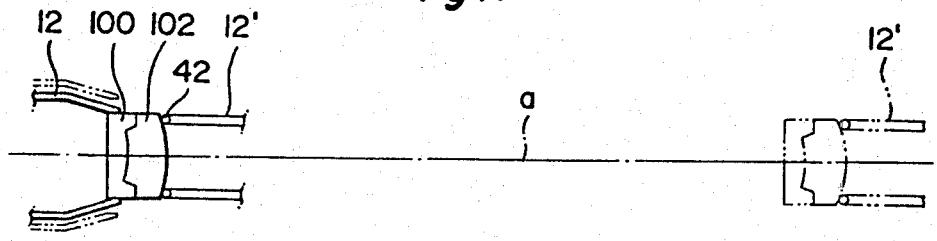
FIG. 7 shows how the work assembly is transferred to the other work holder.

Thereafter, the frame 17 is moved back in the direction indicated by the chain line in FIG. 2 and the work holder 12 and the tool 50 are stopped from rotation. Then the work holder 12' is moved forward and the spherical surface 103 of the machinable piece 102 is attracted to the work holder 12' through the aforesaid O ring as shown in FIG. 7. In this case, the machinable piece 102 has its spherical surface 103 attracted to the work holder 12' while being attached to the work 100 held by the work holder 12, so that when the spherical surface 103 has been released from the work holder 102 as indicated by the chain lines, the work assembly is surely transfered to the work holder 12' without changing its attitude.

Accordingly, an element cut out at a certain angle bearing an important relation to the crystal axis of a raw material, such as a crystal resonator, can be subjected to double surface machining without changing the axis. With the conventional machining method, however, as the axis is changed by the transfer of the work from one work holder to the other, the double surface machining cannot be performed; therefore, it will be appreciated how epoch-making the method of the present invention is.

Figure 8:
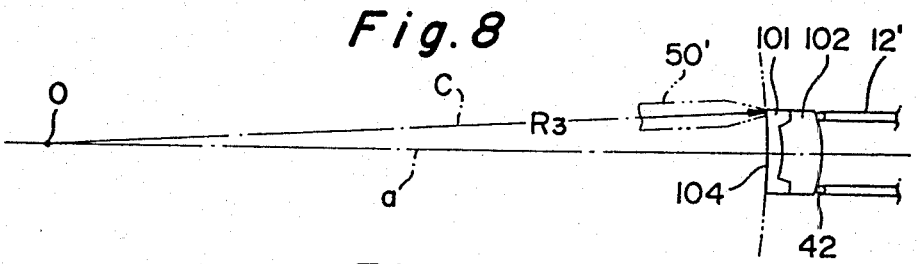
FIG. 8 shows how the other side of the work transferred to the other work holder is machined.

After the work assembly is transferred to the work holder 12', the work holder 12' is brought back to the position indicated by the chain lines in FIG. 7. Then the other surface of the work 100 is machined by a tool 50', held by the tool holder 16', into a spherical surface 104 with a radius $R_3$ centering around the intersection as illustrated in FIG. 8. In this case, it is a matter of course that the work holder 12 is held at such a position that it does not interfere with the tool 50.

After the machining, the work assembly is removed from the work holder 12' and the work 100 is disassembled from the machinable piece 102 through the use of a solvent, obtaining the grooved and ring-supported resonator 4 shown in FIG. 1(*b*).

Figure 9:
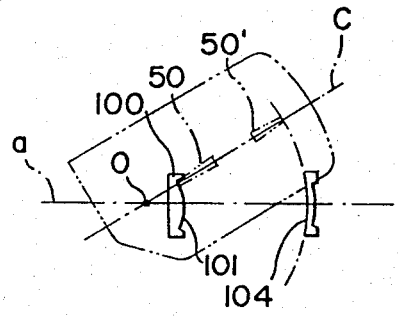
FIG. 9 shows how the machining operations in FIGS. 6(*b*) and 8 are performed by both tools 50 and 50*i* mounted on the same frame.

In this case, the both surfaces of the resonator body are machined by the two tools 50 and 50', provided on the same frame 17, into spherical surfaces centering around the intersection O on the reference center axis a as shown in FIG. 9; accordingly, the both surfaces of the resonator body are machined into lens-shaped configurations which are completely symmetrical with respect to the reference center axis. In addition, the radii of the spherical surfaces can be arbitrarily set by adjusting the screws 40 and 40'. The use of the machinable piece allows machining of very small-diametered works.

Figure 10:
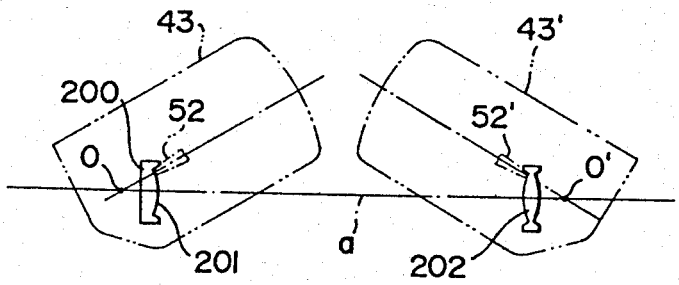
FIGS. 10 and 11 schematically show other examples of the frame.

In the case of obtaining the grooved and ring-supported resonator 1 of the configuration shown in FIG. 1(*a*), a frame 43 rotatable about the intersection O and another frame 43' rotatable about an intersection O' are provided in place of the frame 17 as shown in FIG. 10. One surface of a work 200 is machined by a tool 52, held by the frame 43, into a spherical surface 201 and the other surface of the work 200 is machined by a tool 52', held by the frame 43', into a spherical surface 202. In this case, a machinable piece is used for machining a very small-diametered work, though not shown.

Figure 11:
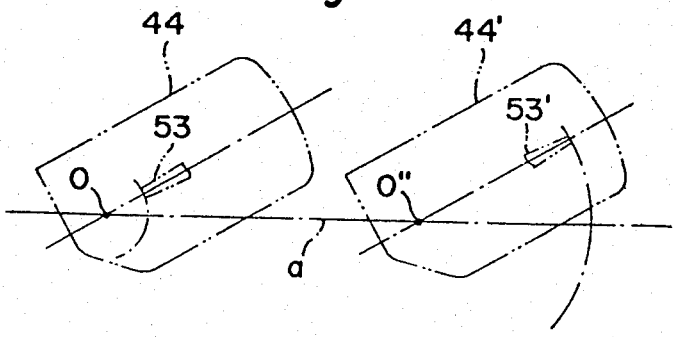

Further, in the case where it is desired that the radius of the spherical surface on the other side (on the side of the concave) of the grooved and ring-supported resonator of the configuration shown in FIG. 1(*b*) is made small, the frame 17 is split into frames 44 and 44' which are rotatable about intersection O and O', respectively, as depicted in FIG. 11. One surface of the work (a machinable piece) is machined by a tool 53 held by the frame 44 and the other surface of the work is machined by a tool 53' held by the frame 44'.

In the case of machining a relatively large-diametered work, no machinable piece is used and one spherical surface of the work is attracted directly to the other work holder for machining the other spherical surface of the work.

By the manufacturing apparatus and procedure described above, it is also possible to obtain the grooved and ring-supported resonators of the configurations shown in FIGS. 1(*c*) to 1(*g*) in addition to the configurations of FIGS. 1(*a*) and 1(*b*).

When to perform machining of the surface of a work following such a procedure as described in the foregoing, if the height of the tool holder supported by the frame is changed in association with the rotational movement of the tool held by the tool holder (the rotational movement of the frame), the surface of the work can be machined into other configurations than the spherical one.

As has been described in the foregoing, since the grooved and ring-supported resonator of the present invention has a support frame formed as a unitary structure with the outer periphery of the resonator body, it is possible to eliminate mismatching of vibration between the resonator and the support system and to prevent the occurrence of sub-vibration.

Furthermore, the use of the manufacturing apparatus of the present invention permits easy fabrication of grooved and ring-supported resonators with their precision and enables the manufacture of small resonators of high Q as well.

Figure 12:
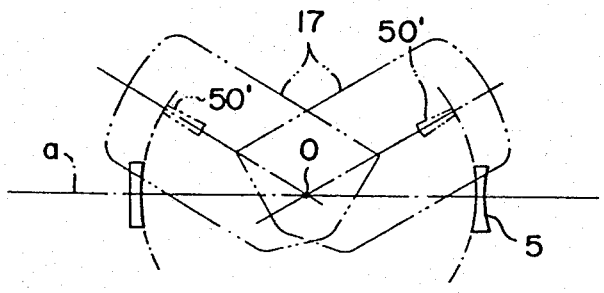
FIG. 12 shows how both sides of a concave lens-shaped article are machined.

While in the foregoing the present invention has been described in connection with the grooved and ring-supported resonator of crystal, the present invention is applicable to an optical lens formed of glass. In this case, the lens has a support frame, and hence it can easily be incorporated. The lens may also be a concave, framed lens, such as shown in FIG. 1(*b*), which lens can be obtained by the machining operation shown in FIG. 12. As is evident from FIG. 12, both surfaces of the framed lens-shaped article 5 can be machined by the tool 50' mounted on the frame 17.

It will be apparent that many modifications and variations may be effected without departing from the scope of the novel concepts of the present invention.

What is claimed is:

1. Apparatus for the manufacture of a lens-shaped article or the like, comprising:

a pair of facing work holders rotatable about a reference center axis (a) and movable back and forth along the reference center axis;

a frame rotatable about a horizontal axis (b) perpendicularly intersecting the reference center axis;

a pair of tool holders, detachably holding a pair of oppositely facing machining tools and each holder rotatably mounted on the frame on a common center of rotation (c), the center of rotation of the tool holders passing through an intersection of the reference center axis and the horizontal axis; and tool support means connected to the pair of tool holders and to the frame for axially moving the pair of tool holders along the common center of rotation of the tool holders.

2. An apparatus according to claim 1 wherein one of the pair of work holders comprises a suction type holder for holding a spherical surface of a workpiece in a centered relationship with respect to the reference center axis.

* * * * *